US006242725B1

(12) United States Patent
Murata et al.

(10) Patent No.: US 6,242,725 B1
(45) Date of Patent: Jun. 5, 2001

(54) HEAT COOKING DEVICE ALLOWING CONTROL OF FAN ROTATION NUMBER

(75) Inventors: Junji Murata, Kusatsu; Yoshihito Fukuda, Kouga-gun; Takashi Fukuda, Kyoto, all of (JP)

(73) Assignee: Sanyo Electric Company, Ltd., Osaka (JP)

( * ) Notice: Subject to any disclaimer, the term of this patent is extended or adjusted under 35 U.S.C. 154(b) by 0 days.

(21) Appl. No.: 09/594,821

(22) Filed: Jun. 16, 2000

(30) Foreign Application Priority Data

Jun. 21, 1999 (JP) ..... 11-173721

(51) Int. Cl.[7] ..... H05B 6/80; H05B 6/68

(52) U.S. Cl. ..... 219/757; 219/681; 219/400; 219/702; 126/21 A; 126/299 R

(58) Field of Search ..... 219/757, 681, 219/400, 702; 126/299 D, 299 R, 21 A, 273 A

(56) References Cited

U.S. PATENT DOCUMENTS

| | | | | |
|---|---|---|---|---|
| 4,115,678 | * | 9/1978 | Tachikawa et al. | 219/757 |
| 4,143,646 | * | 3/1979 | Sampsel | 126/299 D |
| 4,886,046 | * | 12/1989 | Welch | 126/299 D |
| 6,093,922 | * | 7/2000 | Kim | 219/757 |
| 6,097,000 | * | 8/2000 | Frasnetti et al. | 219/400 |

* cited by examiner

*Primary Examiner*—Philip H. Leung
(74) *Attorney, Agent, or Firm*—Armstrong, Westerman, Hattori, McLeland, & Naughton, LLP

(57) ABSTRACT

When a hood fan of a microwave oven installed at a high place operates, the air below the microwave oven is guided to a prescribed direction. Namely, the microwave oven may be used as a ventilation fan. When manner of setting of the hood fan is changed, the direction of an air outlet of the fan can be changed. When the hood fan exhausts air to the room, the number of rotation of the hood fan is made lower than when the air is exhausted outside the room.

5 Claims, 18 Drawing Sheets

HEAT COOKING DEVICE ALLOWING CONTROL OF FAN ROTATION NUMBER

BACKGROUND OF THE INVENTION

1. Field of the Invention

The present invention relates to a heat cooking device and, more specifically, to a heat cooking device including a fan for feeding air from an inlet to an outlet through an air path.

2. Description of the Background Art

A conventional heat cooking device is provided with a fan for cooling a high voltage transformer or a magnetron as heating means. Among heat cooking devices, for a microwave oven installed at a high place, for example on a wall or on a kitchen cabinet, a fan has been provided not only for cooling but also for allowing use of the device simply as a ventilation fan.

In some of the conventional heat cooking devices, some allow selection of direction of exhaustion of the fan from a plurality of directions. For example, a device of the type installed on a kitchen cabinet, allows the user to select the direction of exhaustion into or out from the room.

In such type of heat cooking device, however, when the direction of exhaustion of the fan is set into the room, the noise at the time of exhaustion or ventilation has been rather large and unpleasant for the user.

SUMMARY OF THE INVENTION

The present invention was made in view of the foregoing, and its object is to provide a heat cooking device which can avoid such unpleasantness of the user.

The heat cooking device in accordance with the present invention includes heating means, an inlet, an outlet, and a fan feeding air from the inlet through an air path to the outlet, additionally including driving means for driving the fan, the fan is installed in any of a plurality of different manners of installation feeding air in different directions, the driving means controls the fan such that the fan rotates at a certain number of rotation within a prescribed range, and the prescribed range of the number of rotation is determined dependent on the manner of installation of the fan.

In the heat cooking device of the present invention, the range of the number of rotation of the fan is determined dependent on the manner of installation of the fan. Therefore, it becomes possible to lower the number of rotation of the fan only when the direction of exhaustion of the fan may cause noise unpleasant for the user, at the time of exhaustion.

Preferably, the different manners of installation include a first manner of installation in which the fan feeds air to the room, and a second manner of installation in which the fan feeds air to the outside, and the driving means determines the prescribed range for the first manner of installation to be smaller in the number of rotation, than the prescribed range for the second manner of installation.

Accordingly, when the fan exhausts air to the room, the number of rotation of the fan is made lower than when the air is exhausted to the outside, possibly lowering noise at the time of exhaustion.

Preferably, the manner of installation of the fan is changeable, and the device further includes input means capable of receiving as an input information of the manner of installation after the change. The driving means determines the prescribed range of the number of rotation based on the information of the manner of installation after the change input through the input means.

Accordingly, it is possible for the user to change the manner of installation of the fan, and the fan rotates at an appropriate number of rotation, in accordance with the manner of installation after the change.

Preferably, there are a plurality of outlets, the fan includes a cover capable of feeding air to any of the plurality of outlets and opening/closing a prescribed outlet among the plurality of outlets, and cover opening/closing means capable of controlling opening/closing of the cover, the cover opening/closing means keeps the cover in the closed state and opens/closes the cover in accordance with the operation of the fan only when the fan is installed in such a manner of installation in that the air is fed to the prescribed outlet.

Accordingly, when it is unnecessary to open the prescribed opening, the opening is closed by the cover. Therefore, entrance of dust or the like to the heat cooking device can surely be avoided.

Preferably, the device further includes an oil filter and a charcoal air filter provided at the inlet.

Namely, a plurality of filters are provided adjacent to each other. Therefore, maintenance including exchange of the plurality of filters is facilitated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described in detail with reference to the figures. In the following, a microwave oven installed at a high place, for example on a kitchen cabinet, will be described as an example of the heat cooking device. The present invention, however, it not limited thereto, and it may be applied to a movable microwave oven not installed at a fixed position. The present invention is applicable to any heat cooking device which has a fan and configured to take the air into the device and to exhaust the air out from the device.

Figure 1A:
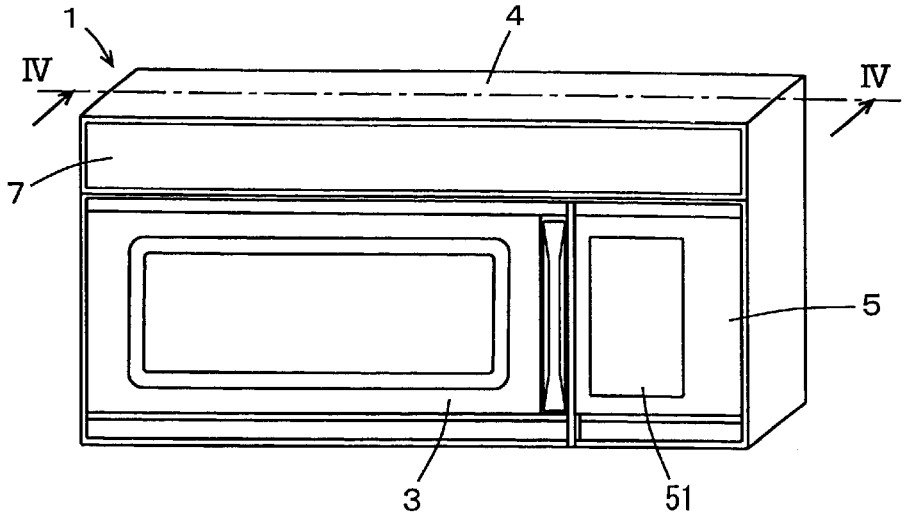
FIGS. 1A and 1B represent a microwave oven in accordance with an embodiment of the present invention.
Figure 1B:
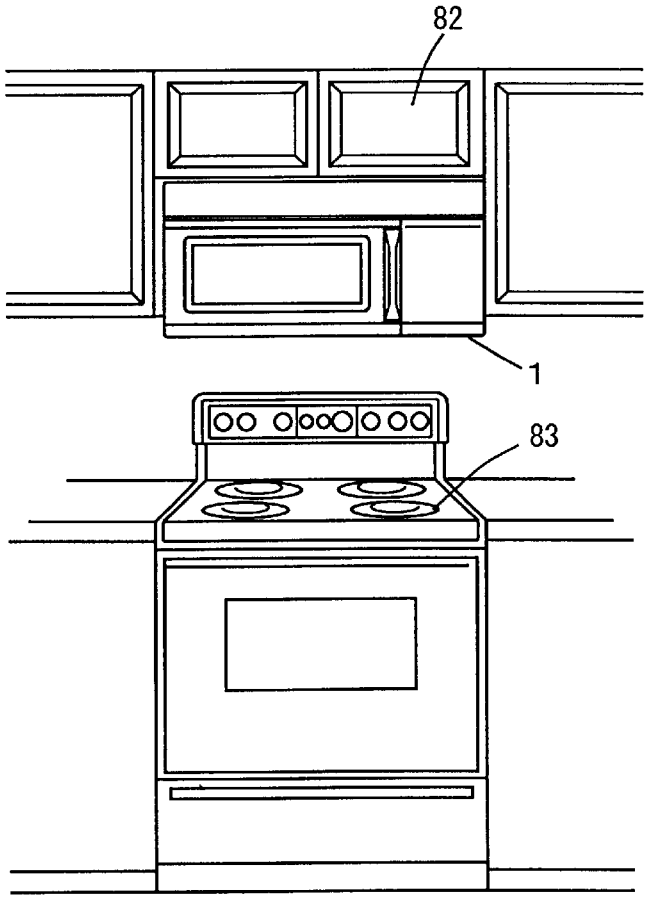

FIGS. 1A and 1B are illustrations of a microwave oven in accordance with an embodiment of the present invention. FIG. 1A shows the appearance of the microwave oven. Microwave oven 1 includes a front panel 5 and a door 3 at the front surface of a body 4. An inlet and an outlet (an inlet 21 and outlets 2, 22 as will be described later, not shown in FIG. 1A) are provided above the front panel 5 and door 3, and a cover 7 is provided to cover the inlet and the outlet. A control panel 51 is provided on front panel 5, allowing the user to input contents of operation of microwave oven 1. Though not shown, a display unit capable of displaying time of cooking and the like is provided on control panel 51. Microwave oven 1 is provided directly above a gas range 83 in a kitchen cabinet 82.

Figure 2A:
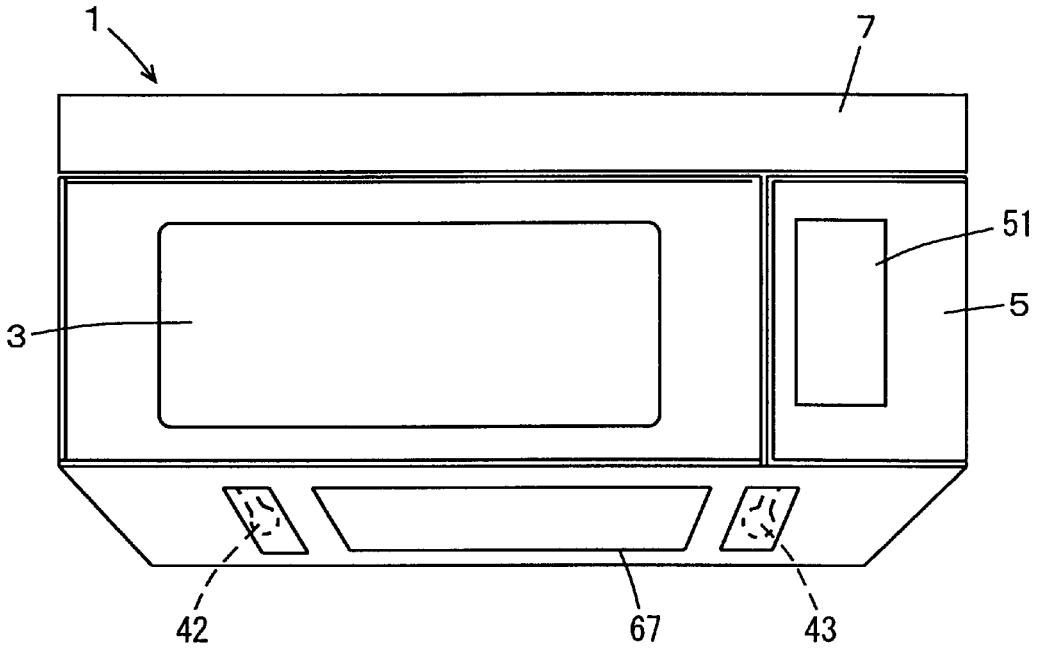
FIGS. 2A and 2B represent details of the configuration of the microwave oven shown in FIGS. 1A and 1B.
Figure 2B:
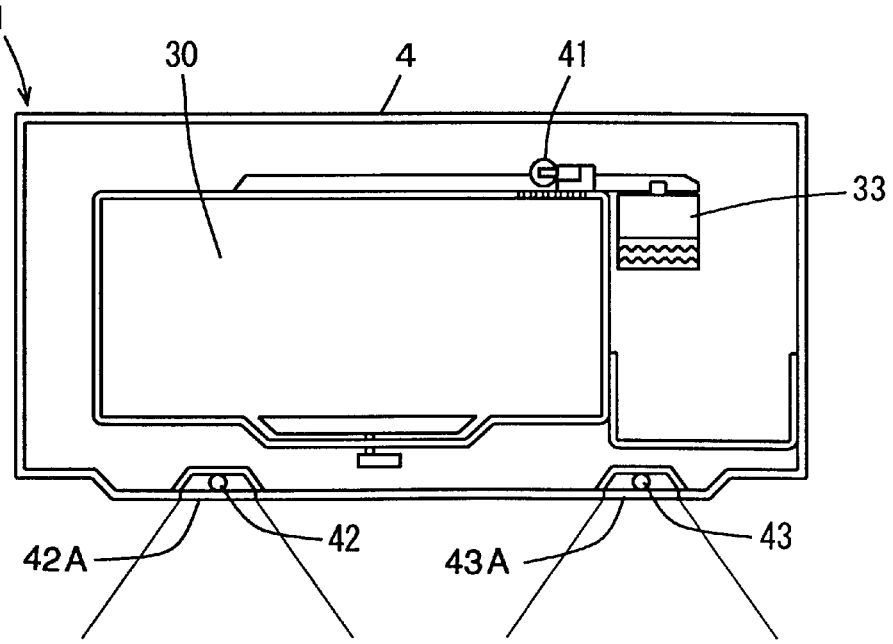

FIGS. 2A and 2B show details of the configuration of microwave oven 1 shown in FIGS. 1A and 1B. FIG. 2A is a perspective view of microwave oven 1 viewed from below. Referring to FIG. 2A, at the bottom portion of microwave oven 1, there are kitchen lamps 42 and 43. When the user cooks using the gas range 83, he/she may turn on kitchen lamps 42 and 43. Heat resistant glasses 42*a* and 43*a* are provided below kitchen lamps 42 and 43, respectively.

A bottom hole 67 is formed in the bottom portion of microwave oven 1. Microwave oven 1 is capable of taking smoke or the like inside microwave oven 1 and exhausting the smoke or the like in an appropriate direction, through the bottom hole 67, by means of a fan provided in the microwave oven. As will be described later, a filter is fitted in the bottom hole 67, and the smoke and the like are taken in to the microwave oven 1 through the filter.

FIG. 2B shows internal structure of microwave oven 1, representing microwave oven 1 with the front panel 5, door 3 and cover 7 detached. Referring to FIG. 2B, there is a heating chamber 30 accommodating the object of heating such food behind the door. A heating chamber lamp 41 for illuminating the heating chamber 30 is provided above heating chamber 30.

Figure 3:
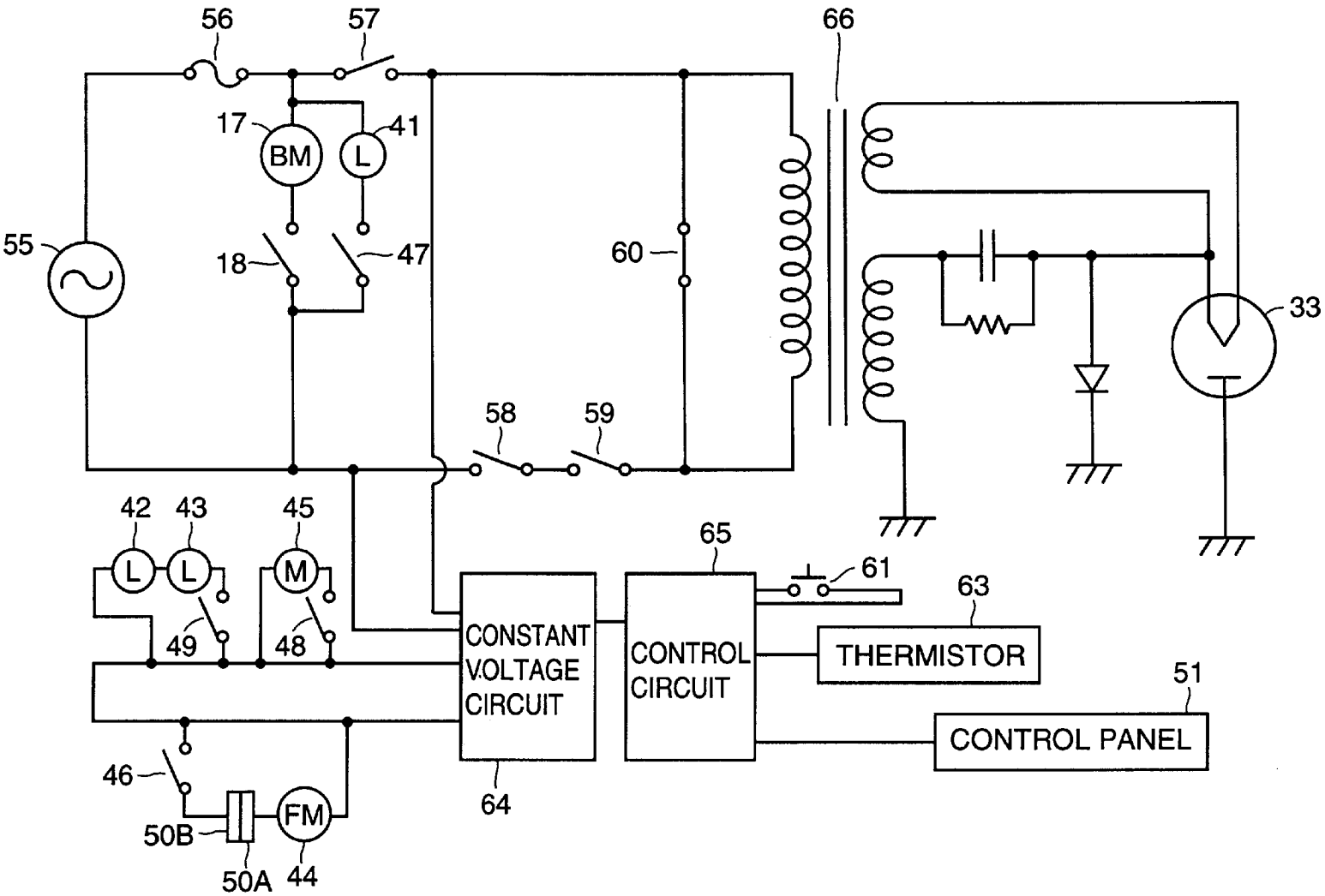
FIG. 3 is a schematic diagram showing electric circuitry of the microwave oven shown in FIGS. 1A and 1B.

FIG. 3 is a schematic diagram showing an electric circuitry for microwave oven 1. Referring to FIG. 3, a reference numeral 55 denotes an AC power supply, supplying power to the entire circuit shown in FIG. 3. Reference numeral 33 denotes a magnetron, and 66 denotes a high voltage transformer supplying a high voltage to magnetron 33.

A switch 57 is a door switch adapted to open the circuit shown in FIG. 3 when door 3 is opened, and closes the circuit when door 3 is closed. Therefore, when door 3 of microwave oven 1 is opened, door switch 57 opens the circuit, preventing power supply from AC power supply 55 to high voltage transformer 66, so as to prevent generation of electric wave from magnetron 33.

In the figure, reference numerals 58 and 59 denote an output adjusting relay and a main relay, regulating conduction of magnetron 33 for heating and cooking. Main relay 59 is kept on while heating and cooking is being performed, while the output adjusting relay 58 is repeatedly turned on/off during heating and cooking, so as to adjust the output of magnetron 33. Output adjusting relay 58 and main relay 59 are turned on/off under the control of control circuit 65.

Control circuit 65 includes a microcomputer and a memory, not shown. Control circuit 65 controls turning on/off of main relay 59 and output adjusting relay 58, in accordance with a cooking recipe input by the user through control panel 51, by means of the microcomputer. Further, control circuit 65 stores cooking information, such as heating time, in the memory as needed. In the figure, reference numeral 64 denotes a constant voltage circuit supplying a power of a constant voltage to control circuit 65.

Reference numeral 60 denotes a monitor switch which is adapted to close the circuit shown in FIG. 3 when door 3 is opened and to open the circuit when door 3 is closed, contrary to door switch 57. Monitor switch 60 ais provided for avoiding conduction of power to magnetron 33 by forming a short-circuit and blowing off fuse 56, when the door switch 57 fails to open the circuit by some cause even when door 3 is opened. Accordingly, a dangerous situation where magnetron 33 generates a high frequency electric wave with the door 3 opened can surely be avoided.

In the figure, reference numeral 17 denotes a blower motor driving a fan (fan 34, which will be described later) for cooling magnetron 33 mentioned above. Reference numeral 41 denotes a heating chamber lamp illuminating heating chamber 7. Reference numerals 18 and 47 denote relay switches controlling conduction of power to blower motor 17 and heating chamber lamp 41, respectively. Relay switches 18 and 47 are turned on/off under the control by control circuit 65.

Kitchen lamps 42 and 43 are connected to constant voltage circuit 64. In the figure, reference numeral 49 denotes a relay switch controlling conduction of power to kitchen lamps 42 and 43. A cover motor 45 for opening/closing cover 7, and a fan motor 44 for driving a hood fan (hood fan 8, which will be described later) which is used when microwave oven 1 is made use of a ventilation fan, are also connected to constant voltage circuit 64. Conduction of power to fan motor 44 and cover motor 45 is controlled by relay switches 46 and 48, respectively. Relay switches 46, 48 and 49 are turned on/off under the control of control circuit 65. Fan motor 44 has a connector 50A. Microwave oven 1 has a connector 50B. When connectors 50A and 50B are connected, fan motor 44 is electrically connected to the body of microwave oven 1.

The hood fan (hood fan 8 as will be described later) may be attached in different direction for feeding air. It is possible for the user to detach or remove the hood fan and attach the fan again on the body of microwave oven 1, so as to change the direction of air from the hood fan. The plurality of directions of feeding air includes a direction of feeding air through an outlet (outlet 2) which is opened/closed by cover 7 to the outside of microwave oven 1. The user may input the direction of air feed of hood fan, through control panel 51. Therefore, when the direction of air feed of hood fan is set to feed air out from microwave oven 1 through the outlet (outlet 2) as will be described later, cover 7 is opened/closed in accordance with the operation of the hood fan.

Control panel 51 and a thermistor 63 are connected to control circuit 65. Thermistor 63 is provided near the outlet (outlet 2) of microwave oven 1, as will be described later. When a temperature detected by thermistor 63 is excessively high and cover 7 is closed, control circuit 65 forces cover 7 open. A fan switch 61 is connected to control circuit 65. The operation of fan switch 61 will be described later with reference to FIG. 8 and the like.

Figure 4:
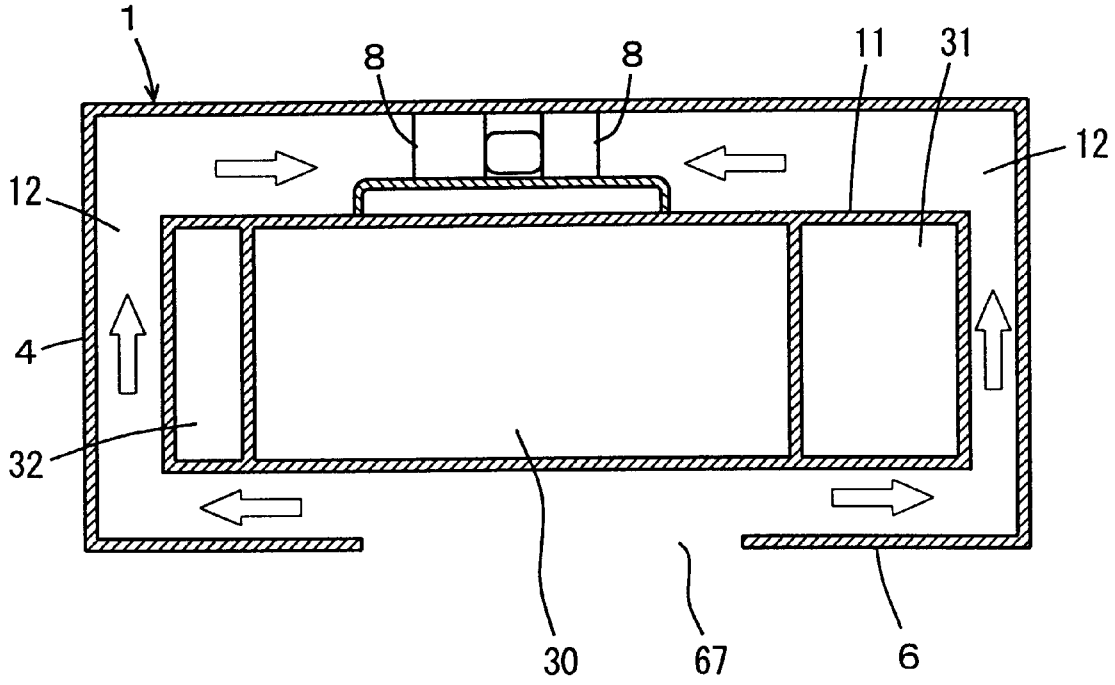
FIG. 4 is a cross section taken along the line IV—IV of FIGS. 1A and 1B.
Figure 5:
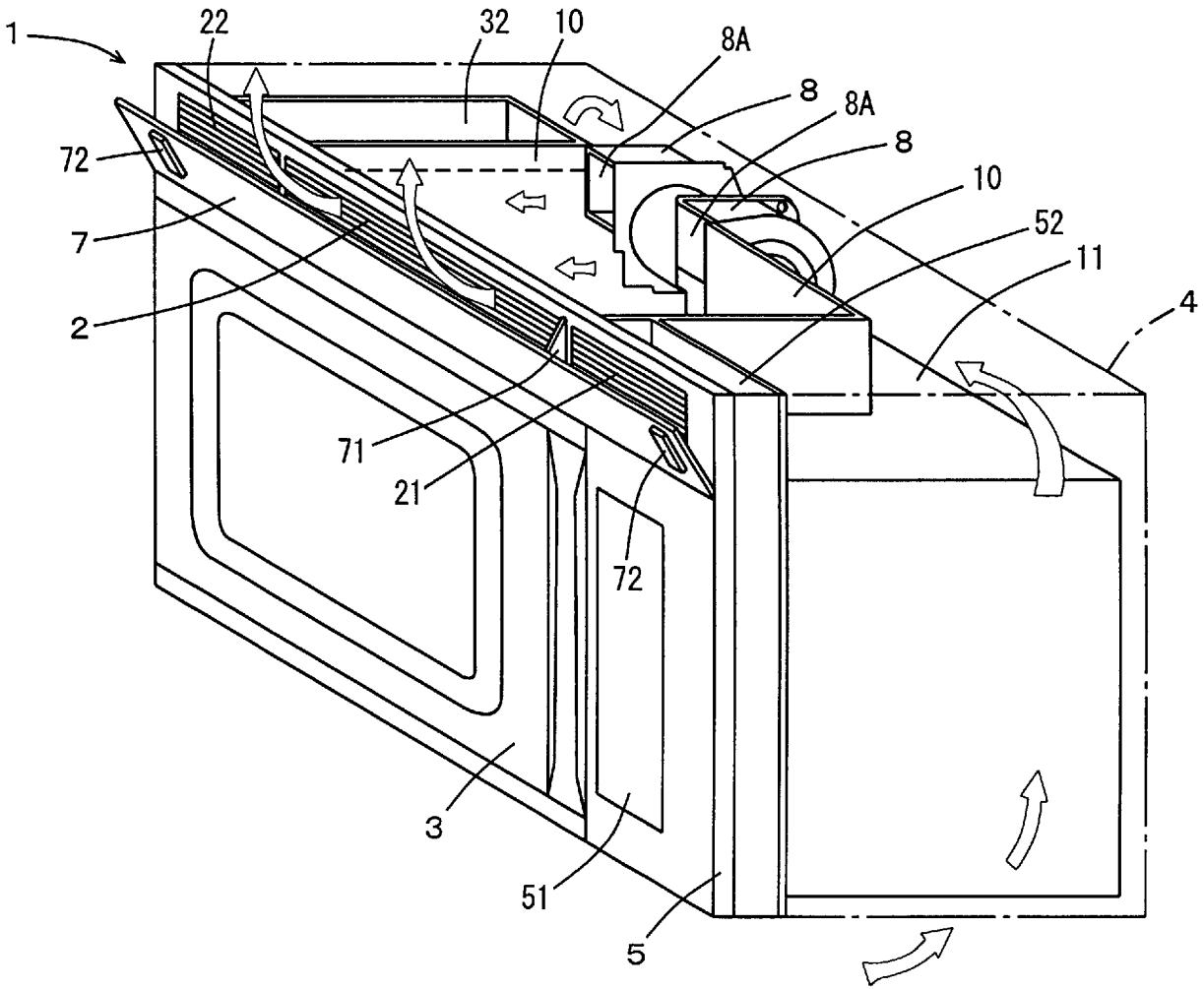
FIGS. 5 and 6 are perspective views of the microwave oven shown in FIGS. 1A and 1B.

FIG. 4 is a cross section taken along the line IV—IV of FIGS. 1A and 1B. FIG. 5 is a perspective view of microwave oven 1 shown in FIGS. 1A and 1B, with an outer casing of body 4 omitted, so as to show the details of the internal structure of microwave oven 1.

Referring to FIGS. 4 and 5, microwave oven 1 includes, in its body 4, an inner frame 11 and an air passage 12. Inner frame 11 is so structured as to surround heating chamber 30, a mechanical chamber 31 accommodating electronic components (magnetron 33 and the like) for heating control and the like, and an exhaustion chamber 32 to which air exhausted from heating chamber 30 is fed. At a bottom plate 6 as a wall surface of air passage 12 and the bottom surface of body 4, a bottom hole 67 is provided. Two hood fans 8 are provided on inner frame 11. An inlet 21 and outlets 2, 22 covered by a cover 7 are formed at an upper portion of front panel 5. In the figure, reference numeral 10 denotes a body guide guiding the air fed from hood fan 8 only to the outlet 2. Though a filter is provided near the bottom hole 67, it is not shown in FIG. 4.

Hood fan 8 outlets air through an outlet opening 8A. When hood fan 8 operates in microwave oven 1, cover 7 is set from the close state shown in FIGS. 1A and 1B to the open state shown in FIG. 5. As represented by white arrows in FIGS. 4 and 5, air is taken from bottom hole 67 to air passage 12, and the air is exhausted through outlet 2 to the outside of microwave oven 1, through hood fan 8. As the cover 7 is provided in front of outlet 2, the air can be exhausted diagonally upward from outlet 2. Namely, cover 7 is capable of controlling the direction of air flow exhausted from outlet 2 (and outlet 22). In this manner, the air is taken from the bottom hole 67 and exhausted through outlet 2 of microwave oven 1, and therefore, microwave oven 1 can be used as a ventilation fan, when gas range 88 is used for cooking.

A partition panel 71 and a handle 72 are provided on cover 7. Partition panel 71 is provided for preventing air exhausted from outlet 2 from directly taken into microwave oven 1 through inlet 21, and handle 72 is provided for enabling manual switching of opening/closing of cover 7. Opening/closing of cover 7 is basically switched by a cover motor 45. Provision of handle 72, however, enables manual opening/closing of cover 7, especially when portions near the inlet 21 and outlets 2, 22 are to be cleaned without operating hood fan 8 or fan 34, or when a member for automatically opening/closing cover 7 fails.

Referring to FIG. 5, reference numeral 52 represents an air chamber to which the air taken through inlet 21 is fed, which chamber is connected to mechanical chamber 31. Microwave oven 1 includes a fan (fan 34, which will be described later) separate from hood fan 8, by means of which the air can be fed in a manner different from the air flow shown in FIGS. 4 and 5. This different air flow in microwave oven 1 will be described in the following, with reference to FIG. 6.

Figure 6:
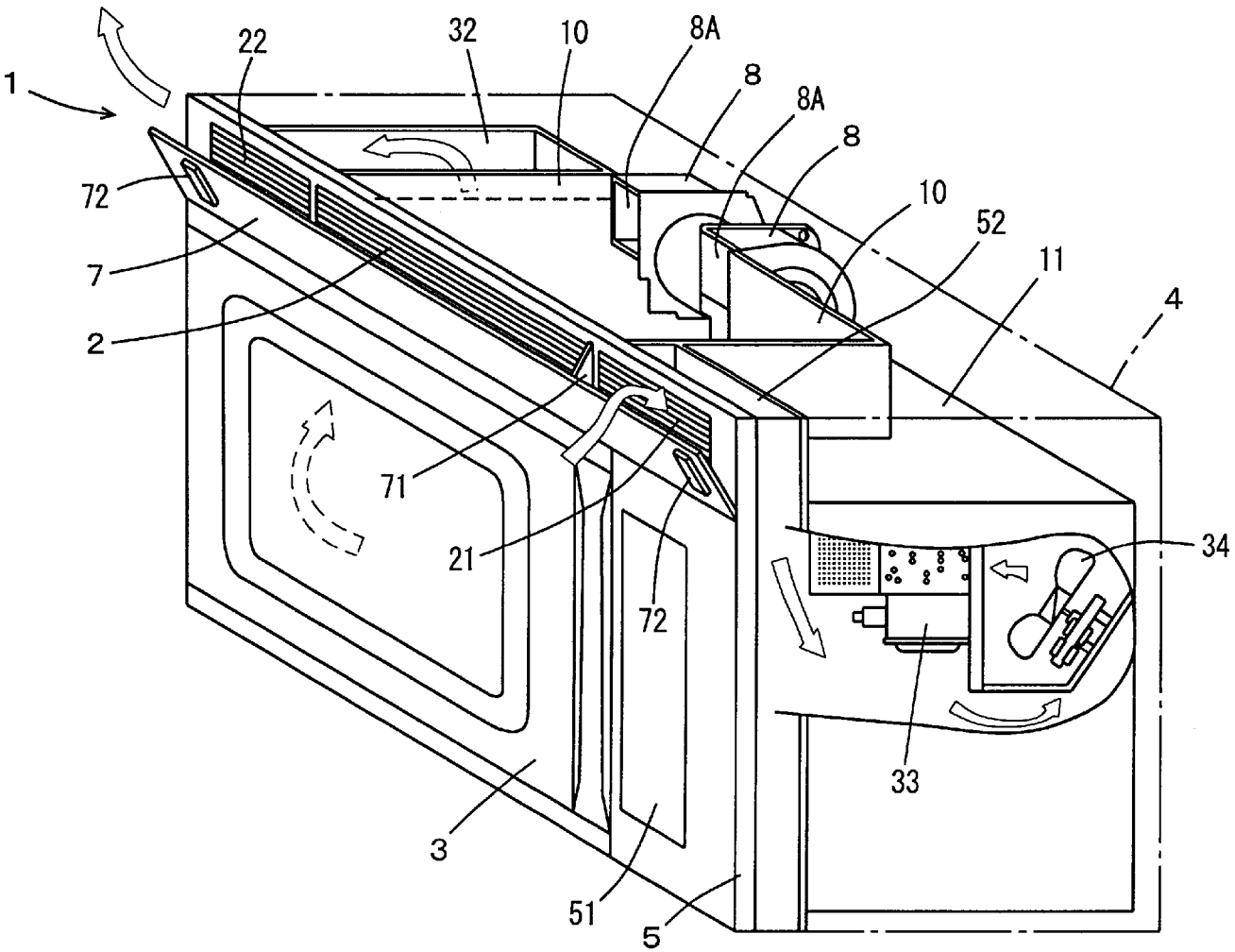

FIG. 6 is a perspective view of microwave oven 1 with an outer case portion of body 4 removed, similar to FIG. 5. In FIG. 6, the air flow in a manner different from that described above is represented by white arrows. Further, in FIG. 6, the inner frame 11 is partially exploded, so as to show the inner structure of mechanical chamber 31.

Microwave oven 1 includes, in mechanical chamber 31, magnetron 33 for heating the object of heating in heating chamber 30, and a fan 34 for cooling components such as magnetron 33. When fan 34 operates in microwave oven 1, cover 7 moves from the closed state shown in FIG. 1 to the open state shown in FIG. 5 (or FIG. 6), the air is taken from inlet 21 through air chamber 52 and mechanical chamber 31 to heating chamber 30, and the air is exhausted through exhaustion chamber 32 and outlet 22 to the outside of microwave oven 1, as represented by the white arrows.

As described above, air flows in different manners in microwave oven 1, by the operations of hood fan 8 and fan 34. In microwave oven 1, when hood fan 8 or fan 34 operates, cover 7 is opened by control circuit 65, in microwave oven 1 as will be described later. When the operation of hood 3fan 8 and fan 34 is stopped, cover 7 is set to the closed state. In microwave oven 1, when heating and cooking by magnetron 33 is performed, fan 34 operates automatically. A hood fan 8 may be operated by a prescribed key operation through control panel 51. In other words, in microwave oven 1, hood fan 8 and fan 34 operate independent from each other.

Referring to FIGS. 5 and 6, outlet opening 8A of hood fan 8 faces forward (in the direction of door 3). As will be described later, the direction of outlet opening 8A of hood fan 8 may be set facing forward, rearward or upward. In the following, the manner of setting of hood fan 8 with the direction of outlet opening 8A facing forward, backward and upward will be referred to as front-setting, back-setting and up setting, respectively.

Figure 7:
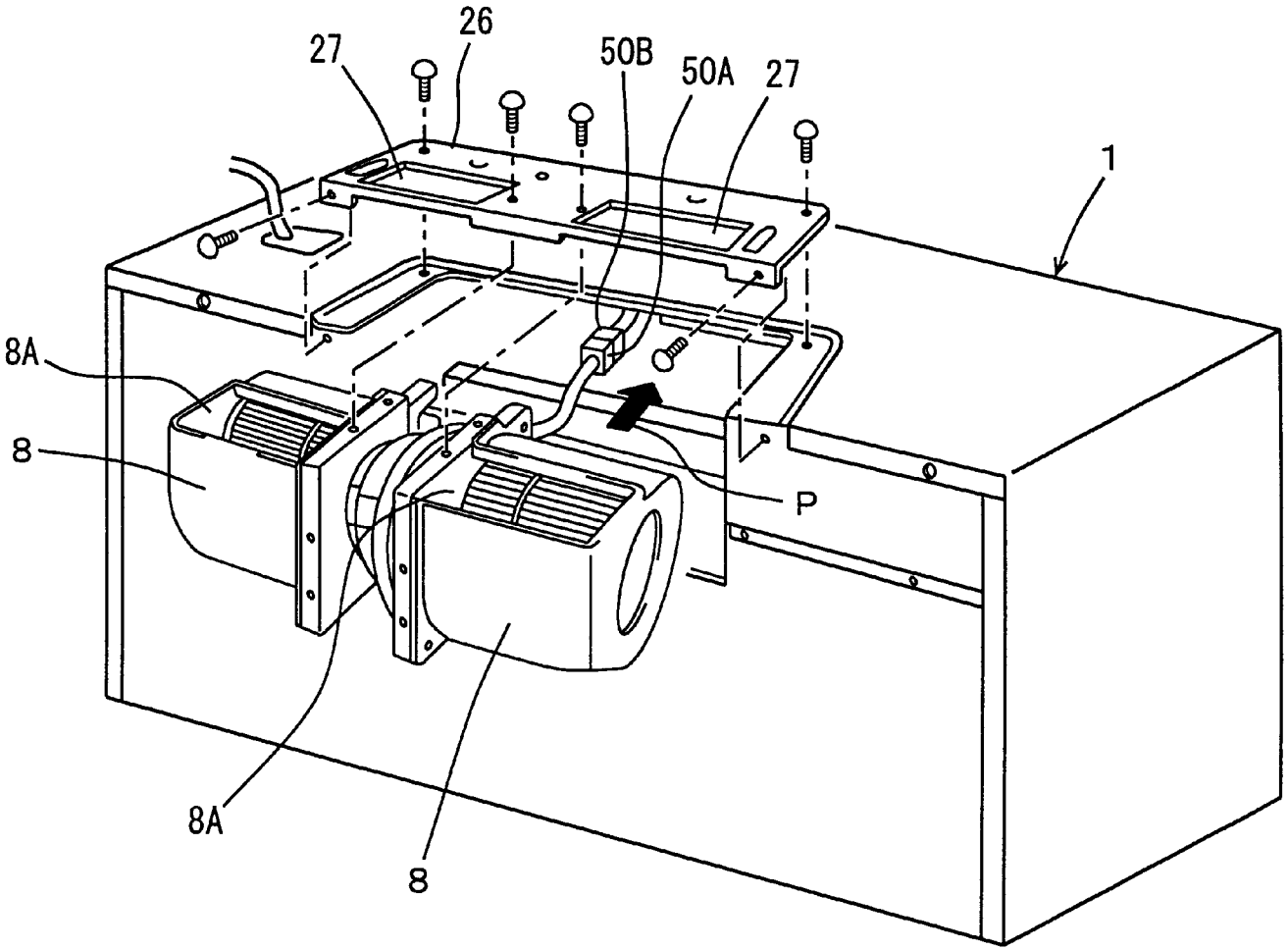
FIG. 7 is an illustration representing how a hood fan is attached to a the body of the microwave oven shown in FIGS. 1A and 1B.

FIG. 7 is an illustration related to attachment of hood fan 8 on microwave oven 1. FIG. 7 is a perspective view of microwave oven 1, viewed from the back-left side. In FIG. 7, hood fan 8 is in up-setting.

Referring to FIG. 7, hood fan 8 is attached in the direction of the arrow P, from behind the body of microwave oven 1. At the time of attachment, a connector 50A of hood fan 8 is connected to a connector 50B on the body of microwave oven 1. In microwave oven 1, a presser plate 26 for fixing hood fan 8 is attached, above hood fan 8. Presser plate 26 is fixed on the body of microwave oven 1 and hood fan 8 by screws. Presser plate 26 has an upper outlet 27. Upper outlet is provided at a position corresponding to outlet opening 8A of hood fan 8. Therefore, even when the hood fan 8 is in up-setting, presser plate 26 does not interfere the air flow coming out from outlet opening 8A.

Figure 8:
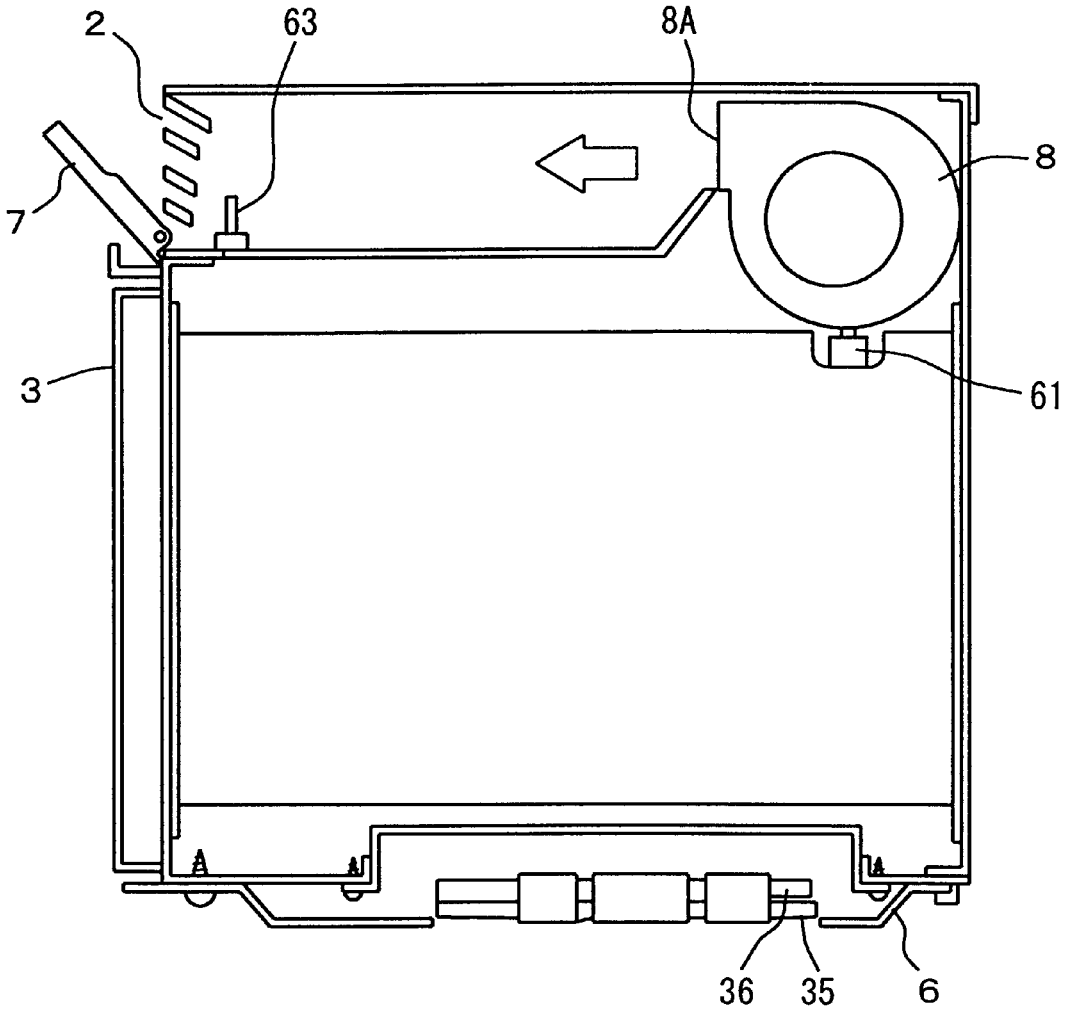
FIG. 8 shows the hood fan installed facing forward, in the microwave oven of FIGS. 1A and 1B.
Figure 9:
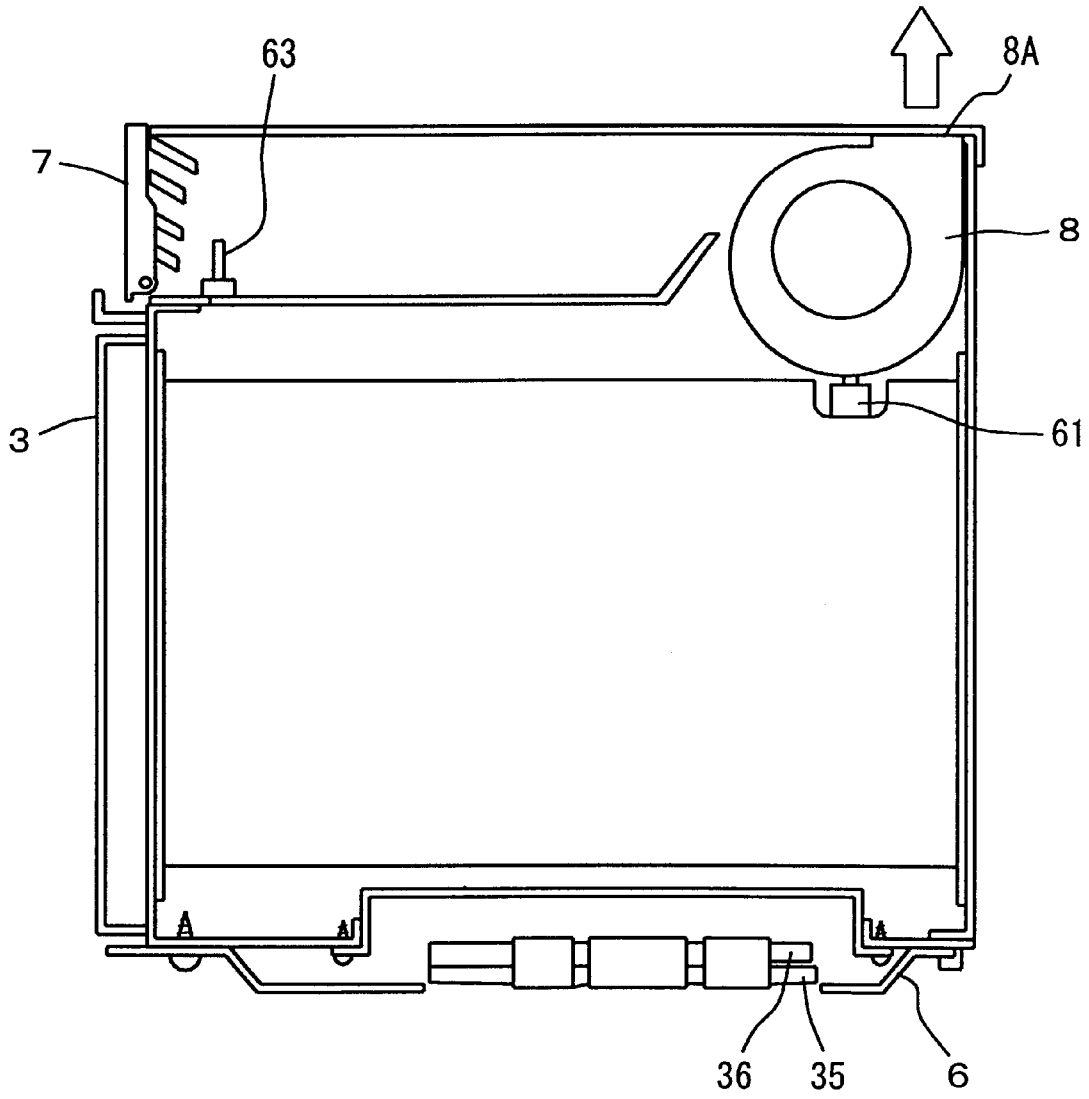
FIG. 9 shows the hood fan installed facing upward, in the microwave oven of FIGS. 1A and 1B.
Figure 10:
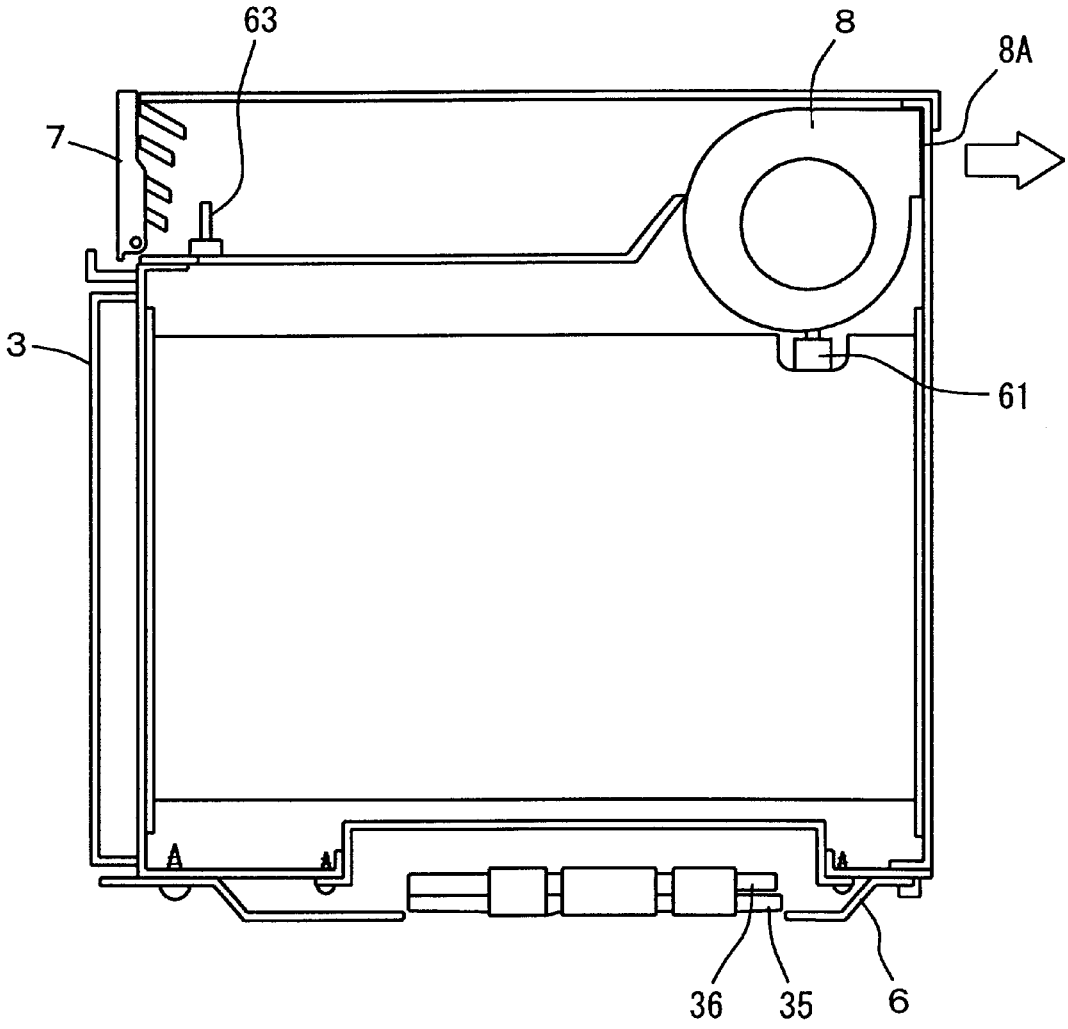
FIG. 10 shows the hood fan installed facing backward, in the microwave oven of FIGS. 1A and 1B.

The front-setting, up-setting and back-setting of hood fan 8 will be described in the following, with reference to FIGS. 8 to 10. FIGS. 8 to 10 are schematic illustrations showing the manner of setting of hood fan 8 viewed from the right side of microwave oven 1, showing hood fan 8 in front-setting, up-setting and back-setting, respectively.

First, referring to FIG. 8, in front-setting, the air blown out from outlet opening 8A proceeds in the direction of the white arrow in the figure, and exhausted through outlet 2 to the outside of microwave oven 1. Below hood fan 8, there is a fan switch 61 arranged. Fan switch 61 has a switch button 62 (see FIG. 11) on an upper portion thereof. In the state shown in FIG. 8, hood fan 8 presses switch button 62, so that the button is embedded in the body of fan switch 61. Fan switch 61 changes the state of opening/closing of the circuitry shown in FIG. 3 dependent on whether switch button 62 is pressed or not. Therefore, it is possible for control circuit 65 to detect whether hoof fan 8 is attached in such a position as shown in FIG. 8, by detecting the state of opening/closing of the circuitry which depends on fan switch 61.

In FIG. 8, it can be seen that microwave oven 1 is provided with an oil filter 35 and a charcoal air filter 36 at its bottom portion. Oil filter 35 is to prevent oil resulting from cooking by gas range 83 from entering microwave oven 1. Charcoal air filter 36 is provided for preventing soot resulting from cooking by gas range 83 from entering microwave oven 1. These filters are supported by a member attached to bottom plate 6. Details of the manner of support will be described later.

Further, it can seen from FIG. 8 that microwave oven 1 includes a thermistor 63 near outlet 2. Control circuit 65 forces cover 7 open when the temperature detected by thermistor 63 is excessively high, as described above. The place where thermistor 63 is provided is not limited to the vicinity of outlet 2.

Referring to FIGS. 9 and 10, no matter whether hood fan 8 of microwave oven 1 is in the up-setting or back-setting state, switch button 62 of fan switch 61 is pressed by hood fan 8.

Microwave oven 1 is configured to allow a user to input the manner of setting of hood fan 8 through control panel 51. When the manner of setting is input to be back-setting or up-setting, cover 7 is basically not open when fan 34 is not in operation, even when hood fan 8 is in operation.

When the manner of setting of hood fan 8 of microwave oven 1 is input to be front-setting, the number of rotation of hood fan 8 (the number of rotation per unit time) is set to be lower than when the setting is input to be back-setting or up-setting, as will be described later.

Figure 11:
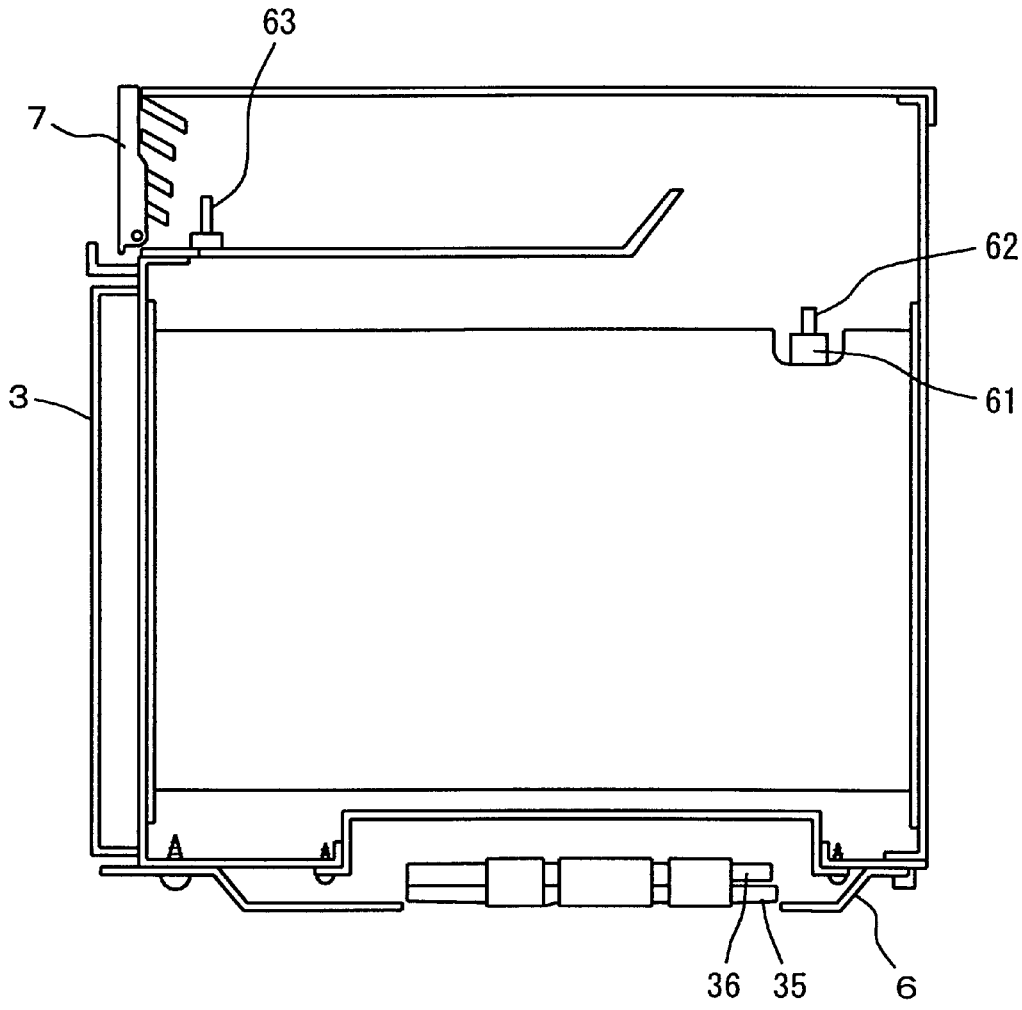
FIG. 11 shows the microwave oven of FIGS. 1A and 1B without the hood fan.

Here, as a reference, FIG. 11 shows a state where hood fan 8 is not attached to microwave oven 1. When hood fan 8 is not attached, switch button 62 is not pressed by hood fan 8 and protruded from fan switch 61, as can be seen from FIG. 11.

Figure 12:
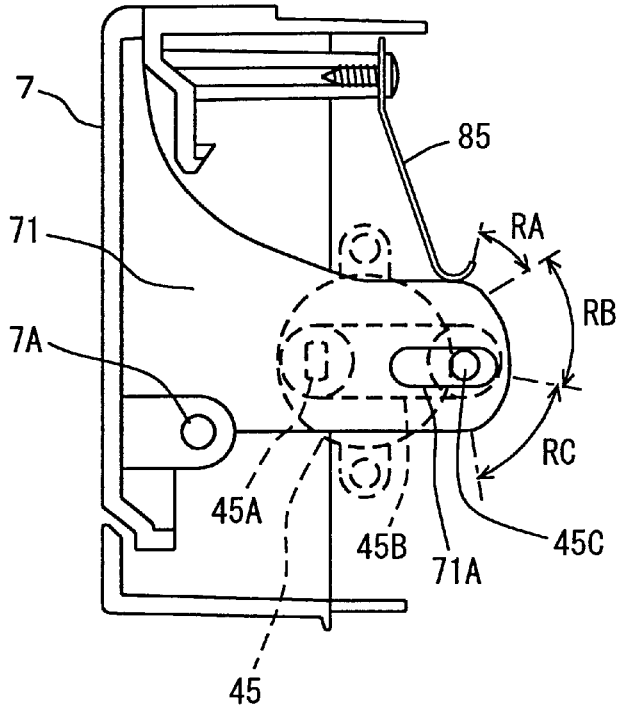
FIGS. 12, 13 and 14 are illustrations showing the cover opening/closing mechanism of the microwave oven shown in FIGS. 1A and 1B.

The mechanism for opening/closing cover 7 will be described with reference to FIGS. 12 to 14. Referring to FIG. 12, cover 7 has a connecting portion 7A and connected to the body of microwave oven 1 through connecting portion 7A. A partition panel 71 of cover 7 has a slit 71A at a back portion thereof.

At a position opposing to the back side of the main surface of partition plate 71, a cover motor 45 is provided. Cover motor 45 has an arm 45B. When cover motor 45 operates, arm 45B rotates, with a center of rotation 45A at one end serving as a fulcrum. A projection 45C is provided at the other end of arm 45B. Projection 45C is fitted in slot 71A. Therefore, when arm 45B rotates, partition panel 71 acts as a cam, opening/closing cover 7.

A leaf spring 85 is provided above partition panel 71. Leaf spring 85 presses at its lower end, an upper end of the rearmost portion of partition panel 71. Therefore, cover 7 as a whole functions as a "lever" (fulcrum: connecting portion 7A, effort: contact with leaf spring 85, load: contact with an outer frame of outlet 2). Therefore, the forward most portion of cover 7 surely closes outlet 2. Namely, when in the closed state (state of FIG. 12), cover 7 is surely fixed in that state. Therefore, there is no space generated between cover 7 and the body of microwave oven 1 when cover 7 is closed. In the state shown in FIG. 12, cover 7 is closed. A mechanism for opening cover 7 from this state will be described in the following.

When cover motor 45 operates in the state of FIG. 12, arm 45B rotates counterclockwise in the figure, with the center of rotation 45A being the fulcrum. Thus, the contact between leaf spring 85 and partition panel 71 gradually shifts backward.

A rear end of partition panel 71 is arcuate. Radius of curvature of the rear end of partition panel 71 differs portion from portion. More specifically, the radii of curvature of the rear end may be RA, RB and RC from the upper portion, as shown in FIG. 12. RA represents the radius of curvature of the upper end portion of the rear end, RB represents radius of curvature of a middle portion of the rear end, and RC represents the radius of curvature of the lower end portion of the rear end. The center of a circle formed by the arc RB is the connecting portion 7A. Further, RA<RB. More specifically, the portion denoted by RA has steeper curve than the portion RB.

Figure 13:
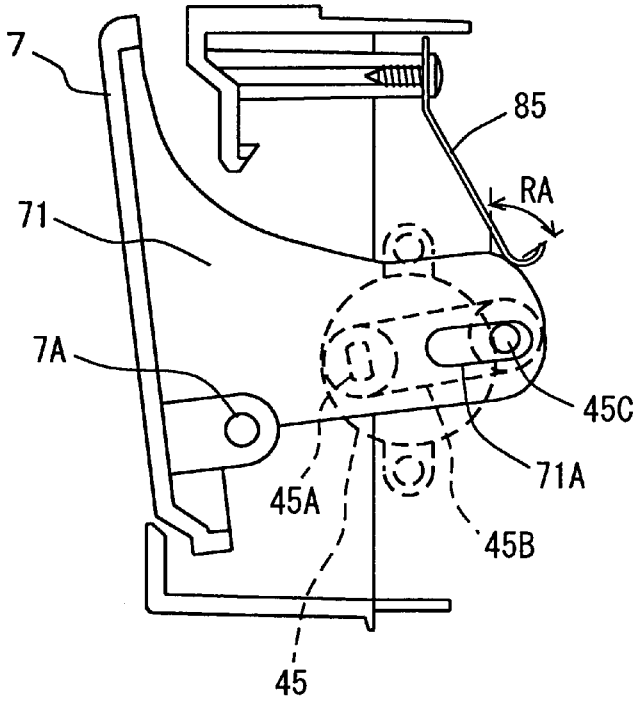

When cover motor 45 operates and arm 45B rotates by a prescribed angle, the contact between leaf spring 85 and partition panel 71 moves to the rearmost end of the range represented by RA, as can be seen from FIG. 13.

Figure 14:
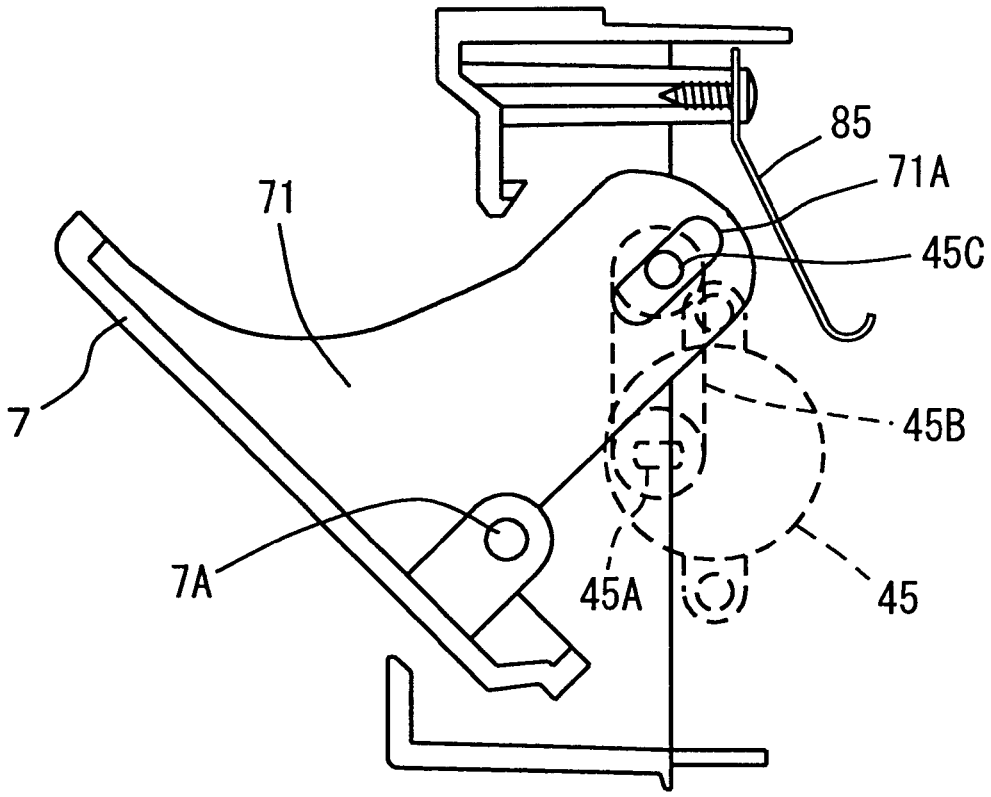

When cover motor 45 further operates from the state shown in FIG. 13, partition panel 71 comes to be in non-contact with leaf spring 85 as shown in FIG. 14. The reason for this may be the fact that RA<RB.

More specifically, in the mechanism for opening/closing cover 7 described with reference to FIGS. 12 to 14, cover 7 opens/closes with a prescribed point (connecting point 7A) serving as a fulcrum. Partition panel 71 has a first portion denoted by RA and a second portion denoted by RB at its rear end. The second portion is continues from the first portion and provided lower than the first portion. The first portion and the second portion have the first and second curvatures, respectively, with the second curvature being smaller than the first curvature. More specifically, the portion denoted by RA has steeper curve than the portion denoted by RB. The center of the circle, a part of which is the second portion, is the fulcrum. When the cover is closed, in the state of FIG. 12, leaf spring 85 engages from upward with the partition panel 71 of cover 7. Here, radius of curvature RB is shorter than the shortest distance between leaf spring 85 and connecting portion 7A (in this case, distance between the lower end of leaf spring 85 and connecting portion 7A). The distance between the region denoted by RA of the outer periphery of partition panel 71 and connecting portion 7A is equal to the shortest distance between leaf spring 85 and connecting portion 7A.

Figure 15:
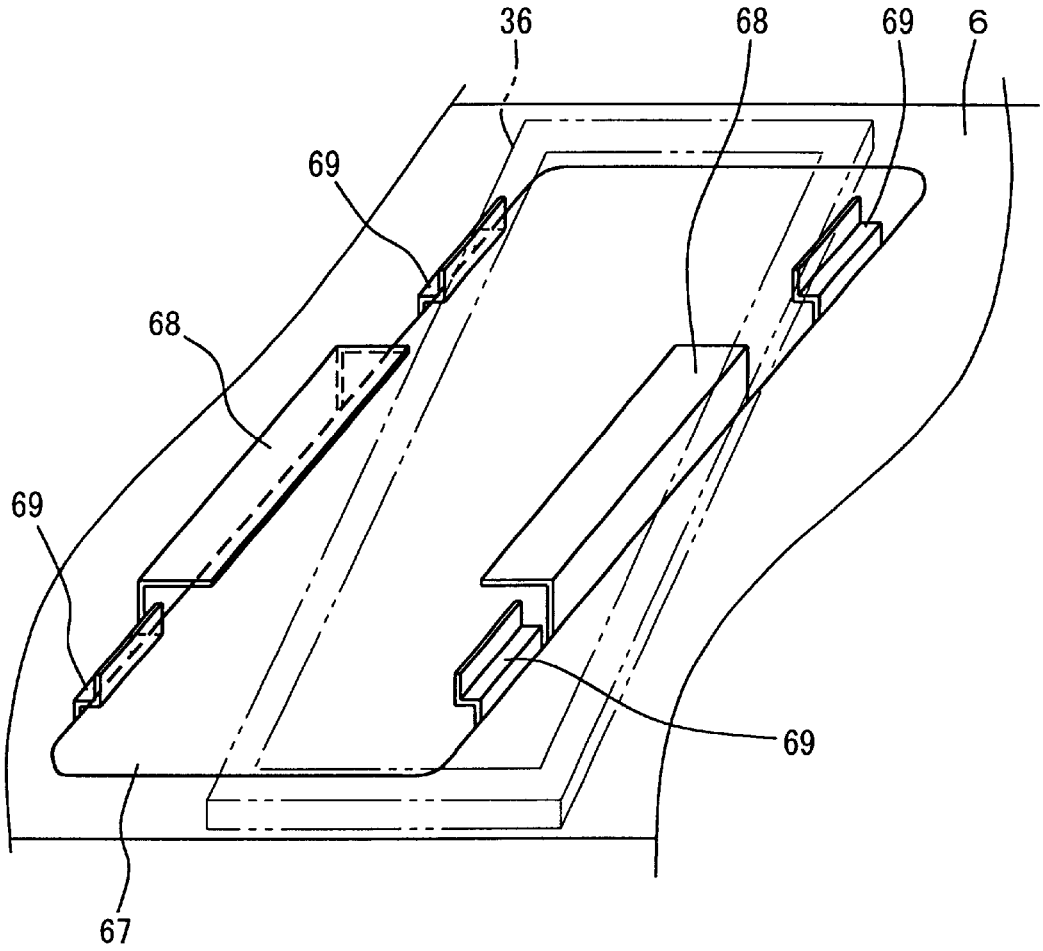
FIG. 15 is an illustration showing the shape of the member for fixing a filter of the microwave oven shown in FIGS. 1A and 1B.

Attachment of oil filter 35 and charcoal air filter 36 will be described in the following. FIG. 15 is an illustration showing the member for fixing oil filter 35 and charcoal air filter 36, which corresponds to the bottom portion of microwave oven 1 viewed from the inside.

In microwave oven 1, there are two pairs of step guides 69 and a pair of top guides 68 provided opposing to each other at an end portion of bottom hole 67. Top guide 68 and step guide 69 are formed integrally with bottom plate 6. More specifically, those portions of bottom plate 6 which are to be cut out as bottom hole 67 are not cut out but left, with the left portions bent to provide top guides 68 and step guides 69. Therefore, the top guides 68 and step guides 69 can be formed without the necessity of preparing material different from the material of bottom plate 6.

Figure 16A:
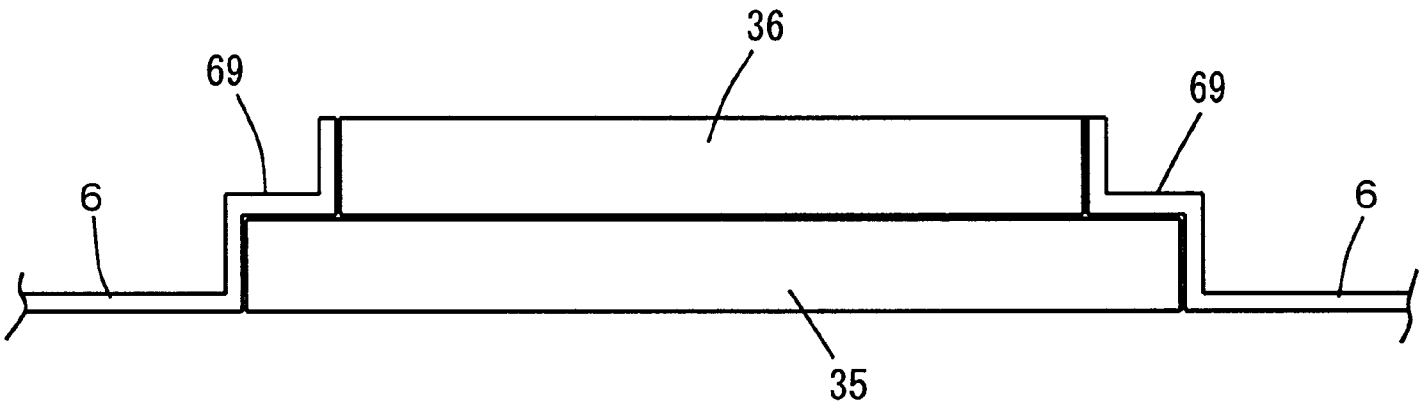
FIGS. 16A and 16B show the manner of supporting an oil filter and a charcoal air filter by stepwise guides and top guides, of the microwave oven shown in FIGS. 1A and 1B.
Figure 16B:
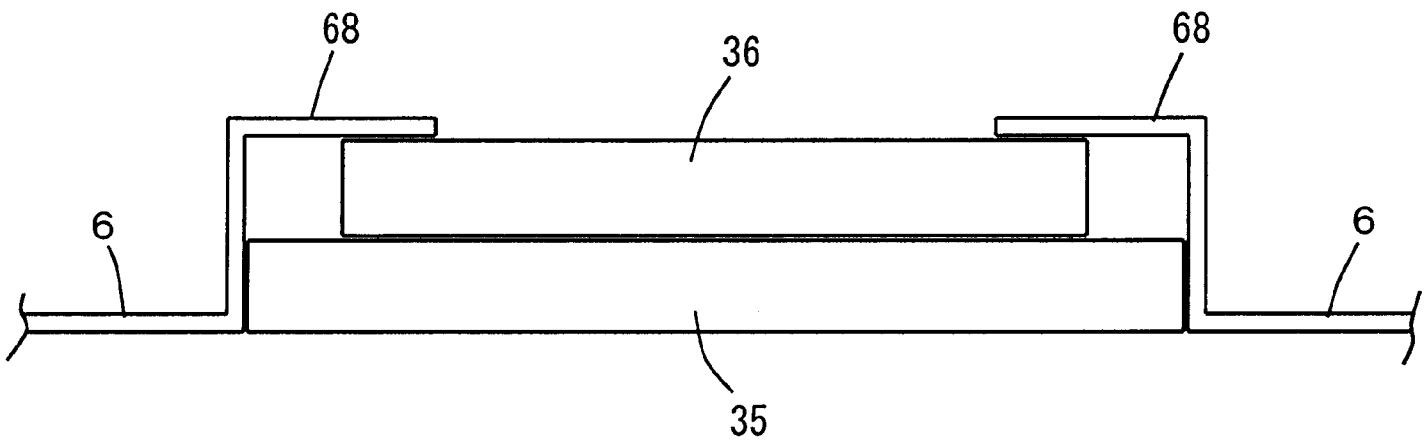

FIGS. 16A and 16B show manner of supporting oil filter 35 and charcoal air filter 36 by step guides 69 and top guides 68. Referring to FIGS. 15 and 16A and 16B, step guide 69 includes, in this order from the lower portion, a first surface continuous from bottom plate 6 and vertical to bottom plate 6, a second surface continuous from the first surface and parallel to the bottom plate 6, and a third surface continuous from the second surface and vertical to the bottom plate 6. More specifically, step guide 69 has two surfaces vertical to bottom plate 6. Upper and lower two surfaces vertical to bottom plate 6 of opposing step guides 69 grip and hold two filters from opposing sides.

Top guide 68 is for pressing from above the upper filter of the two filters (in the present embodiment, charcoal air filter 36).

The manner of attachment of two filters using step guides 69 and top guides 68 will be described with reference to FIGS. 17A to 18C.

Figure 17A:
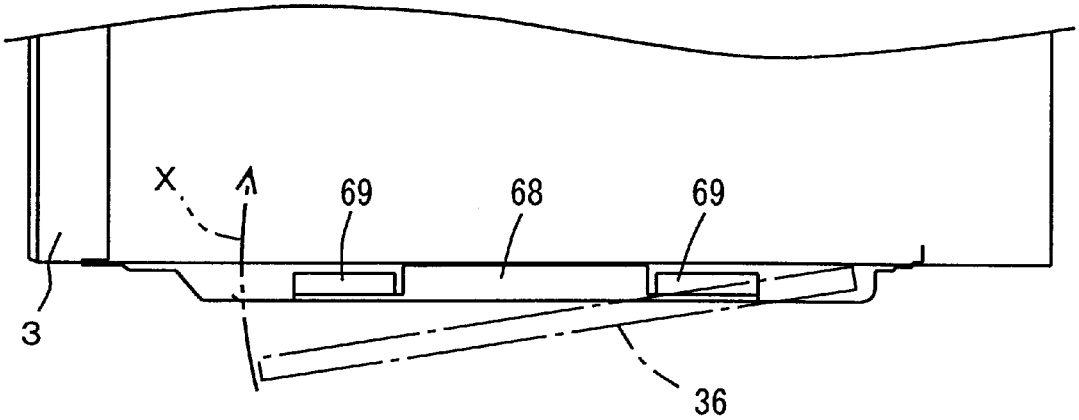
FIGS. 17A and 17B are illustrations showing the manner of attachment of a charcoal air filter in the microwave oven shown in FIGS. 1A and 1B.

When the two filters are to be attached, first, charcoal air filter 36 is attached. Therefore, attachment of charcoal air filter 36 will be described first. Referring to FIG. 17A, a rear end (right end in FIG. 17A) of charcoal air filter 36 is inserted to the inside of microwave oven 1 through bottom hole 67. Thereafter, the front end (left end in FIG. 17A) of charcoal air filter 36 is moved in the direction of the arrow X, that is, upward, to be inserted to the inside of microwave oven 1, through bottom hole 67.

Figure 17B:
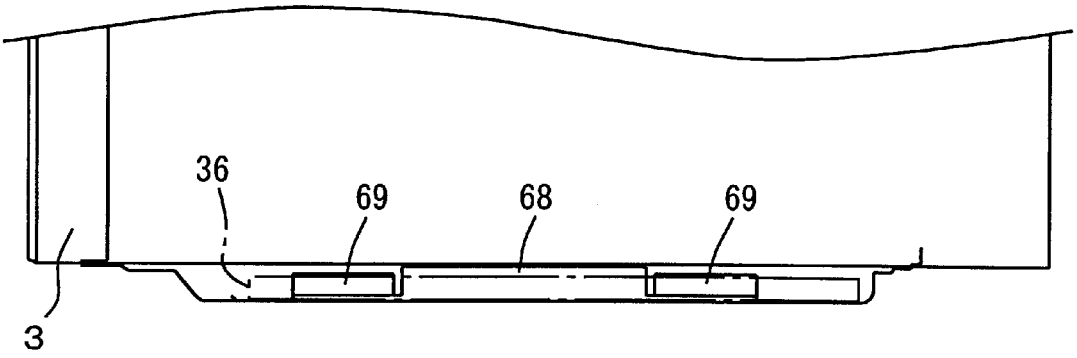

Thereafter, charcoal air filter 36 is fitted in between step guides 69, and thus the charcoal air filter 36 is attached as shown in FIG. 17B.

Figure 18A:
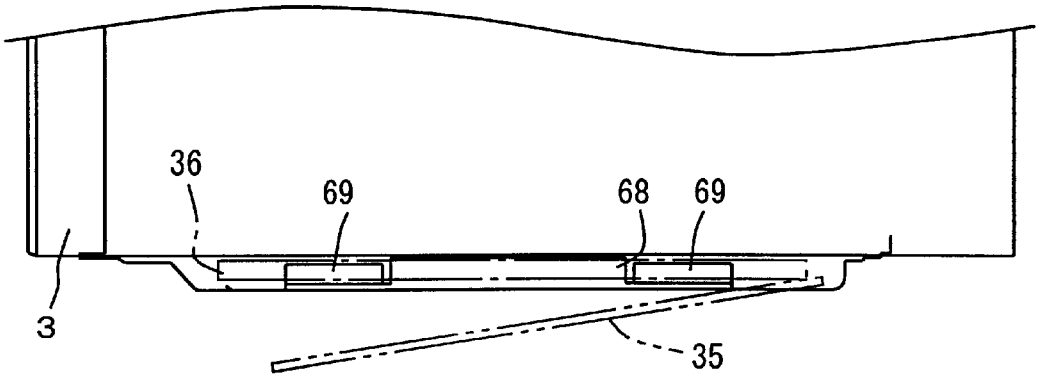
FIGS. 18A, 18B and 18C are illustrations showing the manner of attachment of the oil filter in the microwave oven shown in FIGS. 1A and 1B.
Figure 18B:
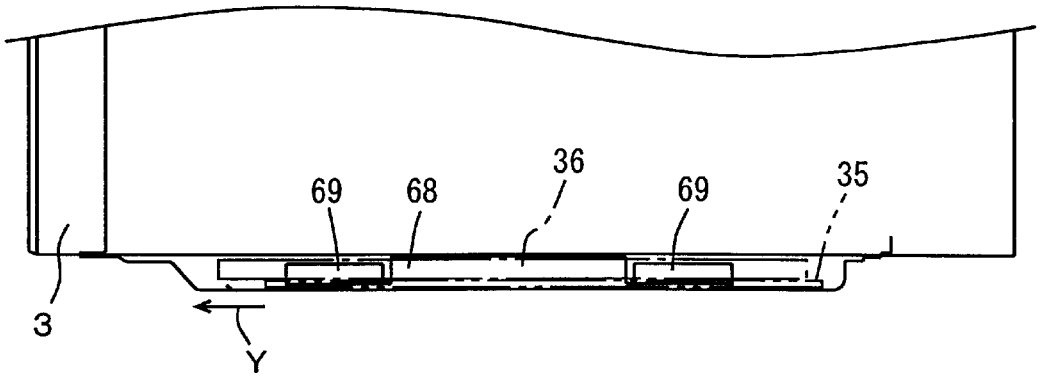
Figure 18C:
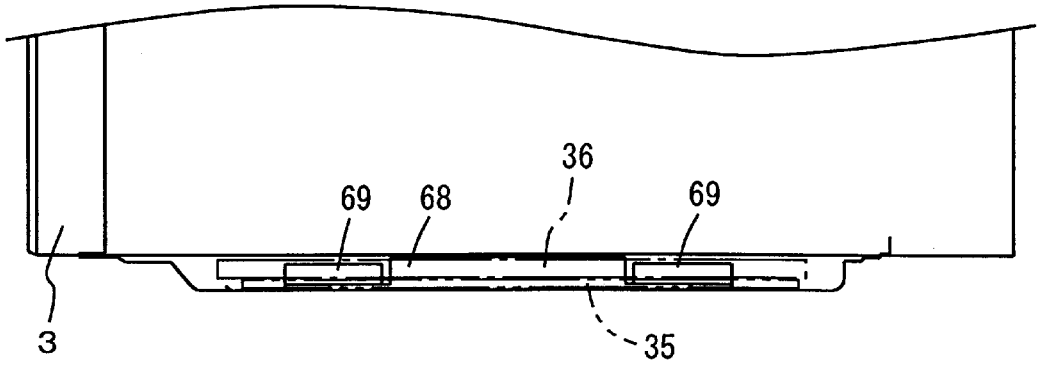

Attachment of oil filter 35 will be described next. Referring to FIG. 18A, the rear end (right end in FIG. 18A) of oil filter 35 is inserted to the inside of microwave oven 1 through bottom hole 67. Thereafter, the front end of oil filter 35 is moved upward so that the oil filter 35 as a whole is inserted to the inside of microwave oven (see FIG. 18B). At this time, oil filter 35 is fitted in step guides 69. However, it is a little displaced backward (to the right in FIG. 18A) from the final position of attachment. Thus, oil filter 35 is moved from this state to the direction of the arrow Y, and the attachment of oil filter 35 is completed as shown in FIG. 18C.

The manner of control by control circuit 65 of microwave oven 1 will be described in the following.

In microwave oven 1, the number of rotation of hood fan 8 can be adjusted in two steps, by control panel 51. Of these two different numbers of rotation, the larger number will be referred to as "High" and the smaller number will be referred to as "Low". Corresponding keys are provided on control panel 51. In the following, these keys will be referred to as High key and Low key.

In microwave oven 1, the value of current to be supplied to fan motor 44 can be adjusted by control circuit 65 in three steps. The three current values will be referred to as "high current", "middle current" and "low current", from the higher one. When the current value supplied to fan motor 44 changes, the number of rotation of hood fan 8, that is, the speed of rotation of hood fan 8 also changes accordingly. The speed of rotation of hood fan 8 when the current value supplied to fan motor 44 is "high current", "middle current" or "low current" will be referred to as "high speed", "middle speed" or "low speed", respectively.

In microwave oven 1, the High key and Low key mentioned above and the speed of rotation of hood fan 8 correspond as shown in Table 1, respectively.

TABLE 1

| Hood Fan | Hood Fan Manner of Setting | | |
|---|---|---|---|
| Speed of Rotation | Front-Setting | Back-Setting | Up-Setting |
| High speed | | High key | High key |
| Middle speed | High key | Low key | Low key |
| Low speed | Low key | | |

In Table 1, the manner of correspondence between respective keys and the rotation speeds differ dependent on the manner of setting of hood fan 8. More specifically, when the fan is in front-setting, the High key corresponds to the middle speed and the Low key corresponds to the low speed. When the hood is in back-setting or up-setting, the High key corresponds to the high speed and the Low key corresponds to the middle speed. More specifically, in microwave oven 1, hood fan 8 is rotated at any number of rotation within the prescribed range. The prescribed range refers to the number of rotation corresponding to the low to middle speed when the fan is in front-setting, and it refers to the number of rotation corresponding to the middle to high speed when the hood is in back-setting or up-setting. Namely, the prescribed range is set dependent on the manner of setting of the hood fan.

Figure 19:
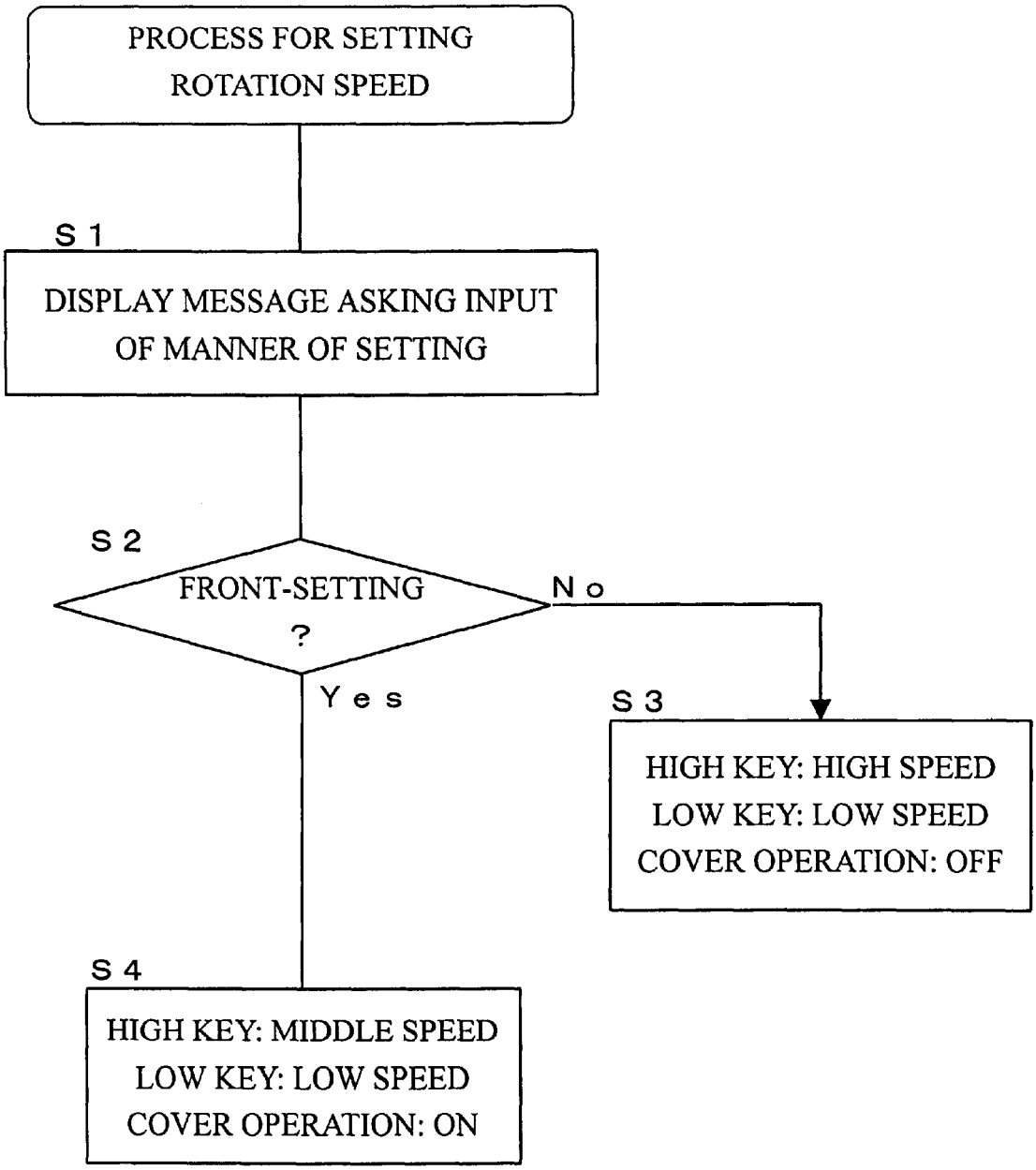
FIG. 19 is a flow chart of a process for setting the speed of rotation, executed by the control circuit, in the microwave oven of FIGS. 1A and 1B.

When power is applied from an AC power supply 55 to microwave oven 1, control circuit 65 executes the process of setting rotation speed. In the process of setting rotation speed, control circuit 65 asks the user to input the manner of setting of hood fan 8. In accordance with the manner of setting of hood fan 8, control circuit 65 sets the correspondence between the High key and the Low key and the speed of rotation of hood fan 8, as shown in Table 1. The process of setting rotation speed will be described in detail, with reference to FIG. 19.

When power is applied from AC power supply 55 to microwave oven 1, control circuit 65 displays, in step S1, a message asking the user to input the manner of setting of hood fan 8, on a display unit of control panel 51, and the flow proceeds to the step S2. The manner of display here may be associated with ten keys "1", "2" and "3", which are originally provided for inputting heating time and the like, adapted to select front-setting, back-setting and up-setting, respectively, asking the user to press either one of these three keys.

In step S2, control circuit 65 determines whether the manner of setting input by the user in step S1 is the front-setting. If it is determined to be front-setting, the flow proceeds to S4, and otherwise, that is, when the setting is determined to be back-setting or up-setting, the flow proceeds to S3. In step S2, whether the setting is front-setting or not is determined. Therefore, the display in step S1 may ask the user to answer whether the setting is front-setting or not.

In step S3, control circuit 65 sets High key to correspond to the high speed and Low key to correspond to the middle speed, sets the cover 7 to be kept closed even when hoof fan 8 is operated, and ends the process. In this case, cover 7 is opened/closed corresponding to the operation of fan 34.

In step S4, control circuit 65 sets the High key and the Low key to correspond to the middle and low speeds, respectively, sets the cover 7 to be opened/closed in accordance with the operation of hood fan 8, and ends the processing. In this case, cover 7 is opened/closed corresponding to the operations of hood fan 8 and fan 34.

In microwave oven 1, it is possible for the user to set the manner of operation of hood fan 8 to a desired manner, by pressing the High key or the Low key. By such a setting, when strong operation of hood fan 8 is desired, the High key may be pressed, and when moderate operation of hood fan 8 is desired, the user may press the Low key, in each manner of setting.

In the process of setting rotation speed described above, when the fan is in front-setting, the speed of rotation of hood fan 8 corresponding to each key is set slower than in other setting manner. More specifically, if the hood is in front-setting, the range of the number of rotation of hood fan 8 is shifted to smaller number side, than in other manner of setting. In microwave oven 1, when hood fan 8 is in the front-setting, the direction of exhaustion from hood fan 8 is to the room, where the microwave oven 1 is installed. When the hood fan is in other setting, that is, when it is in the back-setting or the up-setting, the direction of exhaustion from hood fan 8 is outside the room where microwave oven 1 is installed.

Therefore, in the process of setting rotation speed, the number of rotation of hood fan 8 is made smaller when the direction of exhaustion from hood fan 8 is to the room where microwave oven 1 is installed, than when the direction is to the outside of the room. Generally, when the direction of exhaustion of hood fan 8 is into the room, noise generation is more likely as the hood fan 8 operates. This is because a louver is provided at outlet 2 to turn the direction of exhaustion upward, and the air fed from hood fan 8 is intercepted by the louver.

Microwave oven 1 is adapted such that when the noise is not tolerable for the user, the number of rotation of hood fan 8 is made lower to reduce noise, by executing the process of setting rotation speed.

In the conventional microwave oven installed at a high place, the charcoal air filter is provided in front of the fan which corresponds to hood fan 8. More specifically, it has been positioned between hood fan 8 and outlet 2 in microwave oven 1. In the microwave oven 1 of the present invention, the charcoal air filter 36 is supported and positioned near bottom hole 67 together with oil filter 35. Therefore, operations at the time of maintenance such as attachment and detachment of these filters to microwave oven 1 can be facilitated, and the noise at the time of exhaustion by hood fan 8 in front-setting is reduced.

Here, reduction of noise of hood fan 8 in front-setting will be described in detail. Table 2 represents the amount of air (amount of ventilation) and the magnitude of exhaustion noise of respective manners of setting. In Table 2, the amount of air represents the amount of ventilation through the outlet when hood fan 8 is in operation, in CFM (Cubic Feet per Minutes [$Ft^3$/min]) unit. In this case, the outlet refers to the portion opposing to outlet opening 8A. Namely, in front-setting, it means outlet 2, and in up-setting, it means the upper outlet 27.

In Table 2 "vicinity of bottom hole" means that charcoal air filter 36 is provided near the bottom hole 67 together with oil filter 35, as in the present embodiment. "In the vicinity of outlet" means that the charcoal air filter is placed between hood fan 8 and outlet 2 as in a conventional microwave oven.

TABLE 2

| Hood Fan Speed of Rotation | Front-Setting: In the vicinity of bottom hole | Front-Setting: In the vicinity of outlet | Back-Setting | Up-Setting |
|---|---|---|---|---|
| Amount of Air (/CFM) | 230 | 170 | 300 | 300 |
| Exhaustion Noise (dB) | 65 | 62 | 59 | 56 |

Referring to Table 2, when the hood fan is in front-setting, the exhaustion noise is larger, though the amount of air is smaller as compared with other manner of setting. This is because of the existence of louver, as described above. When charcoal air filter 36 is provided in the vicinity of bottom hole 67 as in the present embodiment, the amount of air is increased by about 35%, that is, 65 CFM, than the conventional microwave oven, with comparable exhaustion noise.

In some cases, the user may wish to increase the power of exhaustion by hood fan 8 regardless of the large noise, with the direction of exhaustion of hood fan 8 being set toward that room. To meet such a demand by the user, microwave oven 1 is adjusted to attain the number of rotation of hood fan 8 corresponding to the High key and the Low key comparable to those in the case of back-setting or up-setting, by a prescribed operation through control panel 51 even when the hood fan is in front-setting, as shown in Table 3.

TABLE 3

| Hood Fan Speed of Rotation | Hood Fan Manner of Setting: Front-Setting | Back-Setting | Up-Setting |
|---|---|---|---|
| High speed | High key | High key | High key |
| Middle speed | Low key | Low key | Low key |
| Low speed | | | |

In the present embodiment described above, means for driving the fan is provided by a fan motor 44 driving hood fan 8 and the control circuit 65 controlling the number of rotation of hood fan 8 by controlling the current value supplied to fan motor 44. Further, hood fan may be attached in such manners as described with reference to FIGS. 8 to 10, and therefore it can be seen that the fan may be set in any of the plurality of manners of setting with different directions of air feed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat cooking device including a heating chamber for accommodating an object for heating, heating means for heating the object, an outer casing covering an outer part of said heating chamber and said heating means, an inlet provided at the outer casing to introduce air to the inside of said outer casing, and an outlet provided at the outer casing to exhaust air to the outside of said outer casing, said heat cooking device comprising:

a fan, for feeding air from said inlet to said outlet, capable of being set in a plurality of direction settings;

means for driving said fan;

wherein the direction of air exhausted by said outlet differs dependent on the direction setting of said fan, and a driving means control such that the fan is rotated at any number of rotations within a prescribed range of rotations per unit time, whereby the prescribed range of said number of rotations per unit time is dependent on said direction setting of said fan.

2. The heat cooking device according to claim 1, wherein said cooking device is installed in a room, said plurality of different direction setting includes a first manner of direction setting at which said fan feeds air to the inside of the room, and a second manner of direction setting at which said fan feeds air to the outside the room; and said driving means determines said prescribed range for said first manner of direction setting to be smaller number of rotation than said prescribed range for said second manner of direction setting.

3. The heat cooking device according to claim 1, wherein said manner of direction setting of the fan is changeable;

said device further comprising input means allowing input of information of the manner of direction setting after the change of said fan; and wherein said driving means determines said prescribed range of the number of rotations based on the information of the manner of direction setting after the change, input through said input means.

4. The heat cooking device according to claim 1, wherein said outlet includes a plurality of outlets;

said fan feeds air to any of said plurality of outlets dependent on the manner of direction setting of the fan;

said device further comprising:

a cover capable of opening/closing a prescribed outlet of said plurality of outlets; and cover opening/closing means capable of controlling opening/closing of said cover, said cover opening/closing means controlling said cover so that it is closed, and controlling said cover to be opened/closed in accordance with an operation of said fan only when said manner of setting of said fan is selected to be such manner of direction setting that feeds air to said prescribed outlet.

5. The heat cooking device according to claim 1, further comprising an oil filter and a charcoal air filter provided at said inlet.

* * * * *